US008322491B2

(12) United States Patent
Crampton

(10) Patent No.: US 8,322,491 B2
(45) Date of Patent: Dec. 4, 2012

(54) LADDER WITH CUSHIONING PAD

(75) Inventor: Richard Henry Crampton, Gresham, OR (US)

(73) Assignee: Working Concepts, Inc., Gresham, OR (US)

( * ) Notice: Subject to any disclaimer, the term of this patent is extended or adjusted under 35 U.S.C. 154(b) by 1597 days.

(21) Appl. No.: 11/340,334

(22) Filed: Jan. 25, 2006

(65) Prior Publication Data

US 2007/0169995 A1 Jul. 26, 2007

(51) Int. Cl.
*E06C 5/32* (2006.01)

(52) U.S. Cl. ..... 182/129; 224/264

(58) Field of Classification Search ..... 182/129; 224/264

See application file for complete search history.

(56) References Cited

U.S. PATENT DOCUMENTS

| | | | | |
|---|---|---|---|---|
| 5,114,107 | A * | 5/1992 | Mahn et al. | 248/217.4 |
| 6,786,371 | B2 * | 9/2004 | Horneman | 224/264 |
| 2002/0046904 | A1 | 4/2002 | Richard | |
| 2002/0179657 | A1 * | 12/2002 | Ladd | 224/264 |
| 2004/0165957 | A1 * | 8/2004 | Serrano et al. | 405/157 |

* cited by examiner

*Primary Examiner* — Alvin Chin Shue

(74) *Attorney, Agent, or Firm* — Chernoff Vilhauer McClung Stenzel LLP

(57) ABSTRACT

A stepladder includes first and second legs and a plurality of treads, wherein each first and second leg forms a separate channel for receiving the treads. A pad installed in the stepladder includes has a first portion residing under compression within the channel of the first leg between adjacent treads and a second portion residing outside of the channel of the first leg to provide the cushion for a worker when carrying the stepladder on his or her shoulder. The pad, suitably consisting of closed-cell foam, is held within the channel by frictional forces between the resilent pad, the first leg and the adjacent treads.

2 Claims, 1 Drawing Sheet

LADDER WITH CUSHIONING PAD

BACKGROUND OF THE INVENTION

1. Field of the Invention

The invention relates in general stepladders and in particular to a stepladder having a pad for cushioning a stepladder when a worker carries it.

2. Description of Related Art

U.S. Patent Application Publication US2002/0046904 of U.S. patent application Ser. No. 09/784,270 filed Feb. 15, 2001 by David J. Richard teaches to attach a soft pad to the inner side of a stepladder rail to provide a cushion when a worker carries the stepladder on his or her shoulder. Richard teaches that the pad should include an interior core of "Styrofoam or ethafoam fill covered with material such as "canvas, fabric, foam, nonelastic material such as polypropylene or a flexible material such as rubber, nylon or spandex", and that the pad should be attached to the rail by such means as "Velcro, rivets, a plethora of snaps or sticky back adhesive." Styrofoam and Ethafoam are Dow Chemical Company brand names for lines of polystyrene and polyethylene foam.

Richard's pad can prevent a stepladder from injuring a worker's shoulder, but attaching such a pad to the stepladder can be problematic. When the pad employs attachment devices such as rivets and snaps requiring the pad installer to form holes in the stepladder rail, the holes can weaken the stepladder, void stepladder warranties and violate safety regulations that prohibit modifying stepladder structural members.

An adhesive can attach a pad to a stepladder rail without structurally damaging the stepladder, but while some adhesives may bond well with one or more of Richard's suggested pad cover materials, and other adhesives may bond well with one or more commonly used stepladder rail materials such as aluminum, steel and fiberglass, it may be difficult to provide an adhesive that can securely attach any one of those pad cover materials to every type of stepladder rail material under all temperature conditions. Adhesives can be messy and difficult to use, may not work well when installed while the stepladder rail is too cold or dirty, can make it difficult for a worker to reposition the pad or to replace the pad when it is worn out, and may fail in the presence of water or other solvents.

Richard's pad is relatively expensive to manufacture since it includes several parts (cover, fill, attachment device) that must be separately manufactured and assembled. Depending on the cover materials used and the manner in which its seams are sealed, Richard's pad may absorb water and other liquids including solvents that may damage the pad or fill material.

What is needed is an inexpensive stepladder pad that can be easily mounted on a stepladder rail without modifying the rail and without adhesives, that can be easily repositioned or replaced, that does not absorb liquids, and that is not damaged by water and most commonly used solvents.

SUMMARY OF THE INVENTION

The invention relates to a stepladder having a pad for providing a cushion for a worker carrying the stepladder on his or her shoulder, or to a method for modifying a conventional stepladder to include the pad. The stepladder includes first and second legs and a plurality of treads, wherein each first and second leg forms a separate rectangular channel for receiving opposing ends of the treads. The stepladder is modified in accordance with the invention to include a resilient pad having a first portion residing under compression within the rectangular channel of the first leg between adjacent treads and a second portion residing outside of the channel of the first leg to provide the cushion for a worker when carrying the stepladder. The pad, suitably consisting of closed-cell foam, is held within the rectangular channel by frictional forces between the resilient pad, the adjacent treads and the first leg.

When it consists only of a block of closed-cell from, the pad is in expensive to manufacture, resists absorbing liquids, and resists damage by water and most other solvents.

Since the pad is held within the channel solely by friction, it is not necessary to structurally modify the stepladder or to use any adhesive in order to affix the pad to the stepladder, and the worker can easily remove and replace or reposition the pad on the stepladder.

The claims appended to this specification particularly point out and distinctly claim the subject matter of the invention. However those skilled in the art will best understand both the organization and method of operation of what the applicant(s) consider to be the best mode(s) of practicing the invention by reading the remaining portions of the specification in view of the accompanying drawing(s) wherein like reference characters refer to like elements.

DETAILED DESCRIPTION OF THE INVENTION

The following describes one particular mode of practicing the invention recited in the claims appended to this specification. Although the following description includes numerous details in order to provide a thorough understanding of that particular mode of practicing the invention, it will be apparent to those of skill in the art that other modes of practicing the invention recited in the claims need not incorporate such details.

Figure 1:
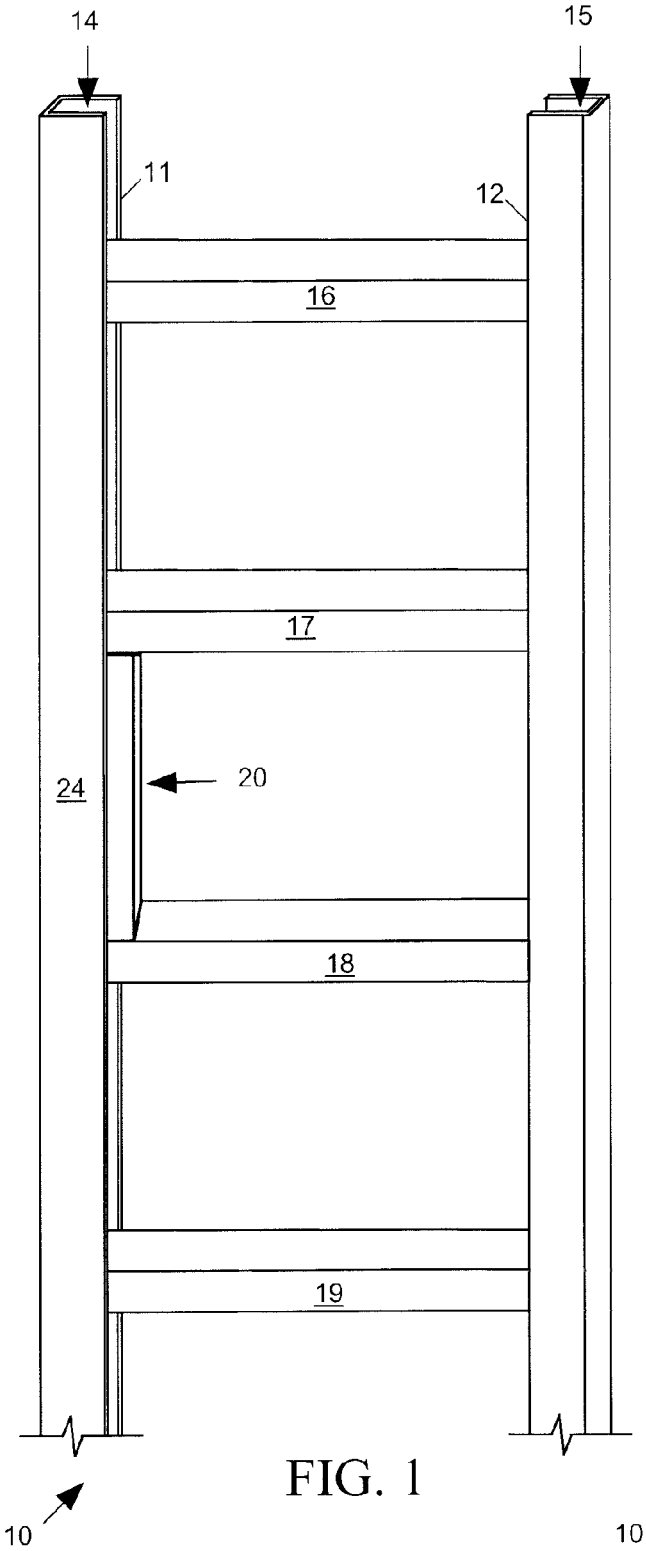
FIG. 1 is a front elevation view of a portion of a stepladder that has been modified in accordance with the invention to include a pad.
Figure 2:
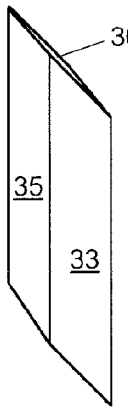
FIG. 2 is a perspective view of the pad of FIG. 1 before being installed in the stepladder.
Figure 3:
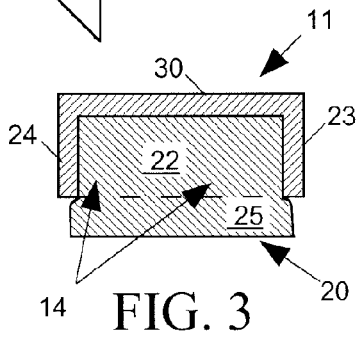
FIG. 3 is a sectional plan view of the pad and one leg of the stepladder of FIG. 1.
Figure 4:
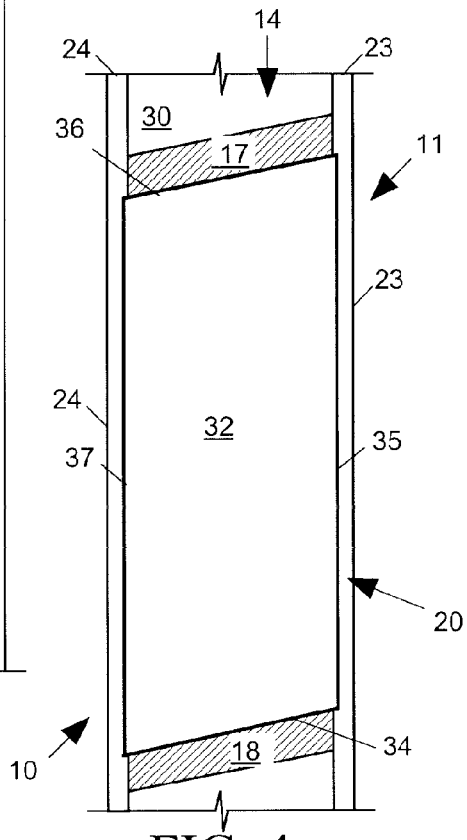
FIG. 4 is a sectional elevation view a portion of the stepladder of FIG. 1.

The invention relates to a stepladder that is modified to provide a cushion for a worker carrying the stepladder on his or her shoulder. FIG. 1 is a front elevation view of a portion of a stepladder 10 that has been modified in accordance with the invention. Stepladder 10 includes opposing first and second front legs 11 and 12 each forming a separate rectangular channel 14 and 15 for receiving opposite ends of a set of treads 16-18. The back legs of step ladder 10 are not shown. In accordance with the invention, stepladder 10 is modified by first forming a resilient pad 20, as illustrated in FIG. 2 and then inserting the pad into first channel 14 between treads 17 and 18 as illustrated in FIGS. 1, 3 and 4.

Pad 20 is suitably shaped as a parallelepiped, having two opposing non-rectangular faces 32 and 33 and four rectangular faces 34-37. When inserted in channel 14 pad 20 fills the space in channel 14 between treads 17 and 18. Non-rectangular face 33 contacts the back wall 30 of leg 11, rectangular faces 35 and 37 contact the side walls 23 and 24 of leg 11, and rectangular faces 34 and 36 contact treads 18 and 17. The distance between non-rectangular faces 32 and 33 exceeds the depth of channel 14 so that a first portion 22 of pad 20 resides within channel 14 and a second portion 25 of pad 20 resides outside channel 14 to provide the cushion for the worker.

When pad 20 is not installed in channel 14, the distance between rectangular faces 35 and 37 is a little wider than channel 14 and the distance between rectangular faces 34 and 36 is a little longer than the distance between treads 17 and 18. Thus it is necessary to compress pad 20 before inserting it in channel 14. Pad 20 therefore resides under compression between side walls 23 and 24 of leg 11 and between treads 17 and 18. That compression creates substantial friction between pad 20, side walls 23 and 24 and treads 17 and 18, and the friction holds pad 20 firmly in place within channel 14. Since pad 20 is held securely within channel 14 solely by friction, it is not necessary to structurally modify first leg 14 or to use any adhesive in order to affix pad 20 to first leg 14. Note that a worker may easily remove and replace or reposition pad 22 on stepladder 10.

Pad 20 suitably consists of closed-cell foam and comprises, for example, a 60-80% copolymer and 20-40% plasticizer. Formed from a single block of closed-cell foam, pad 22 is inexpensive to manufacture, resists absorbing liquids, and is resistant to damage by water and most solvents.

The invention claimed is:

1. For a stepladder comprising opposing first and second legs and a plurality of treads, wherein each first and second leg forms a separate channel having a back wall and two side walls for receiving the treads, a method for providing the stepladder with a cushion for a worker carrying the stepladder, the method comprising the steps of:

a. providing a resilient pad of closed-cell foam in the shape of a parallelepiped having first, second and third pairs of mutually parallel opposite faces, wherein the faces of the first pair are rectangular and are mutually spaced at a distance greater than the channel of the first leg is wide, the faces of the second pair are rectangular and are oblique to the faces of the first pair, and the faces of the third pair are mutually spaced at a distance greater than the channel of the first leg is deep, and b. compressing a first portion of the resilient pad between the first pair of faces and inserting the first portion into the channel of the first leg between two adjacent treads of the stepladder with one of the faces of the third pair confronting the back wall of the channel of the first leg such that the first portion of the resilient pad resides under compression between the side walls of the channel of the first leg and such that a second portion of the resilient pad resides outside of the channel of the first leg to provide the cushion for the worker, and wherein the faces of the second pair contact the two adjacent treads of the stepladder, whereby the resilient pad is held within the channel of the first leg solely by frictional forces between the pad and the side walls of the channel of the first leg and between the pad and the two adjacent treads of the stepladder.

2. A stepladder having a cushion for a worker carrying the stepladder comprising:

opposing first and second legs, a plurality of treads, wherein each first and second leg forms a separate channel having a back wall and two side walls for receiving the treads, and a resilient pad of closed-cell foam in the shape of a parallelepiped having first, second and third pairs of mutually parallel opposite faces, wherein the faces of the first pair are rectangular and are mutually spaced at a distance greater than the channel of the first leg is wide, the faces of the second pair are rectangular and are oblique to the faces of the first pair, and the faces of the third pair are mutually spaced at a distance greater than the channel of the first leg is deep, the resilient pad having a first portion residing under compression between the side walls of the channel of the first leg and a second portion residing outside of the channel of the first leg to provide the cushion for the worker, and wherein the faces of the third pair are in contact with the side walls respectively of the rail of the first leg, one of the faces of the first pair confronts the back wall of the channel of the first leg, and the faces of the second pair are in contact with two adjacent treads respectively of the stepladder and the resilient pad is held within the channel of the first leg solely by frictional forces between the resilient pad and the side walls of the channel of the first leg and between the resilient pad and the two adjacent treads of the stepladder.

* * * * *